US005160303A

United States Patent [19]

Smith

[11] Patent Number: 5,160,303

[45] Date of Patent: Nov. 3, 1992

[54] ELASTIC RESISTANCE EXERCISE DEVICE HAVING RESISTANCE ELEMENT RETAINING STRUCTURE

[76] Inventor: Alvin H. Smith, 10720 Lakewood Blvd., #209, Downey, Calif. 90241

[21] Appl. No.: 679,256

[22] Filed: Apr. 2, 1991

[51] Int. Cl.[5] ..... A63B 21/02

[52] U.S. Cl. ..... 482/123; 482/126; 482/79; 482/44

[58] Field of Search ..... 482/121, 122, 126, 129, 482/79, 44, 123, 130

[56] References Cited

U.S. PATENT DOCUMENTS

| | | | |
|---|---|---|---|
| 2,488,534 | 11/1949 | Hagerman | 482/129 |
| 3,640,529 | 2/1972 | Kane | 482/130 |
| 3,822,061 | 7/1974 | Sigma | 482/126 |
| 4,129,297 | 12/1978 | Dolan | 482/123 |
| 4,310,155 | 1/1982 | White | 482/121 |
| 4,314,469 | 2/1982 | Brumfield et al. | 482/123 |
| 4,582,320 | 4/1986 | Shaw | 482/130 |
| 4,618,144 | 10/1986 | Gibson | 482/130 |
| 4,634,115 | 1/1987 | Hawkins | 482/123 |
| 4,8709,923 | 12/1987 | Gibson | 482/130 |

*Primary Examiner*—Richard J. Apley
*Assistant Examiner*—Lynne A. Reichard
*Attorney, Agent, or Firm*—Edgar W. Averill, Jr.

[57] ABSTRACT

A compact and easily adjusted exercising device useful for exercising the upper arms, shoulders, calves or the like. The device has a base which may be supported on a desk, table or floor. A pair of uprights support an upper bar over which one or more rubber bands are placed. This bar is removable when it is desired to change the rubber bands. A hollow lower bar is held between the uprights and the one or more rubber bands pass over this bar. A handle supporting bar is then slid through vertical slots in the uprights and through the center of the lower supporting bar. This provides a light, easily adjusted exercising device which can be easily used by the busy executive or even by bedridden persons.

11 Claims, 3 Drawing Sheets

ELASTIC RESISTANCE EXERCISE DEVICE HAVING RESISTANCE ELEMENT RETAINING STRUCTURE

BACKGROUND OF THE INVENTION

The field of the invention is exercise devices, and the invention relates more particularly to lightweight exercising devices useful for exercising the upper arms, shoulders, calves or the like. Elastic members have been used in exercising devices for many years. An early device is shown in the Bailey U.S. Pat. No. 829,754. This device, however, is not easy to adjust and would be dangerous if the elastic member broke. A spring-type exercising device is shown in the Weiss et al. U.S. Pat. No. 3,815,904 where a plurality of rubber bands are supported between a clamped lower bar and a U-shape upper bar. This device may be used for exercising the arms, back or legs depending on where the lower bar is attached. Like the Bailey device, the Weiss device has no safety provisions if one or more of the rubber bands breaks, and it is, likewise, not easy to adjust. A hand exercising device is shown in the Palmer U.S. Pat. No. 4,783,067. This uses a pair of rubber bands on the exterior of the device and although the bands are very easily changed, the exercising device is quite limited to either exercising the hand or the chest. No safety provisions are provided in the event one of the rubber bands breaks.

The United Kingdom Patent No. 2,148,136A shows an arm exercising apparatus which has a hand grip to which one or more elastic cords may be affixed. The other end of the elastic cords are snapped to a support bar. No provisions are made for safety in the event of a breakage of one of the elastic cords. Lastly, the French Patent No. 74-04066 shows a chest exercising device which has three loops welded to a U-shaped support clamp. Three elastic members are attached to a handle and permit the user to exercise by pulling a handle away from the support brace.

The above devices all have useful provisions, but none of them may be safely used on a desk top while still being easily adjustable.

SUMMARY OF THE INVENTION

It is an object of the present invention to provide a lightweight portable exercising device which may be used on a desk top, table or on the floor, which device is both safe to use and easy to adjust.

The present invention is for a compact and easily adjusted exercising device useful for exercising the upper arms, shoulders, calves or the like. The device has a base supportable on a desk, table or on the floor. A pair of opposed uprights extend upwardly from the base, and each of the uprights has a generally vertical slot formed therein, and the slots are aligned toward the base. At least one elastic member or rubber band is supported by the upper support bar. A lower elastic member support bar is supported by the elastic member or rubber band and is hollow which permits a handle supporting bar to be inserted through it and also through the generally vertical supports in the opposed uprights. Preferably, the device is covered with a safety cover, and the handle support bar has a handle inserted at each end. In order to increase the number of rubber bands or to replace a broken band, one of the handles from the handle support bar is removed, and the handle support bar is slid out from the lower elastic member support bar. Then, the upper member support bar is removed from the opposed uprights, and the elastic members may be added or changed as desired after which the device is reassembled. Preferably, the vertical slots terminate sufficiently far above the bottom of the base so that if one or more of the rubber bands breaks, the hands do not strike the floor or desk or other surface upon which the device is supported.

DESCRIPTION OF THE PREFERRED EMBODIMENTS

Figure 1:
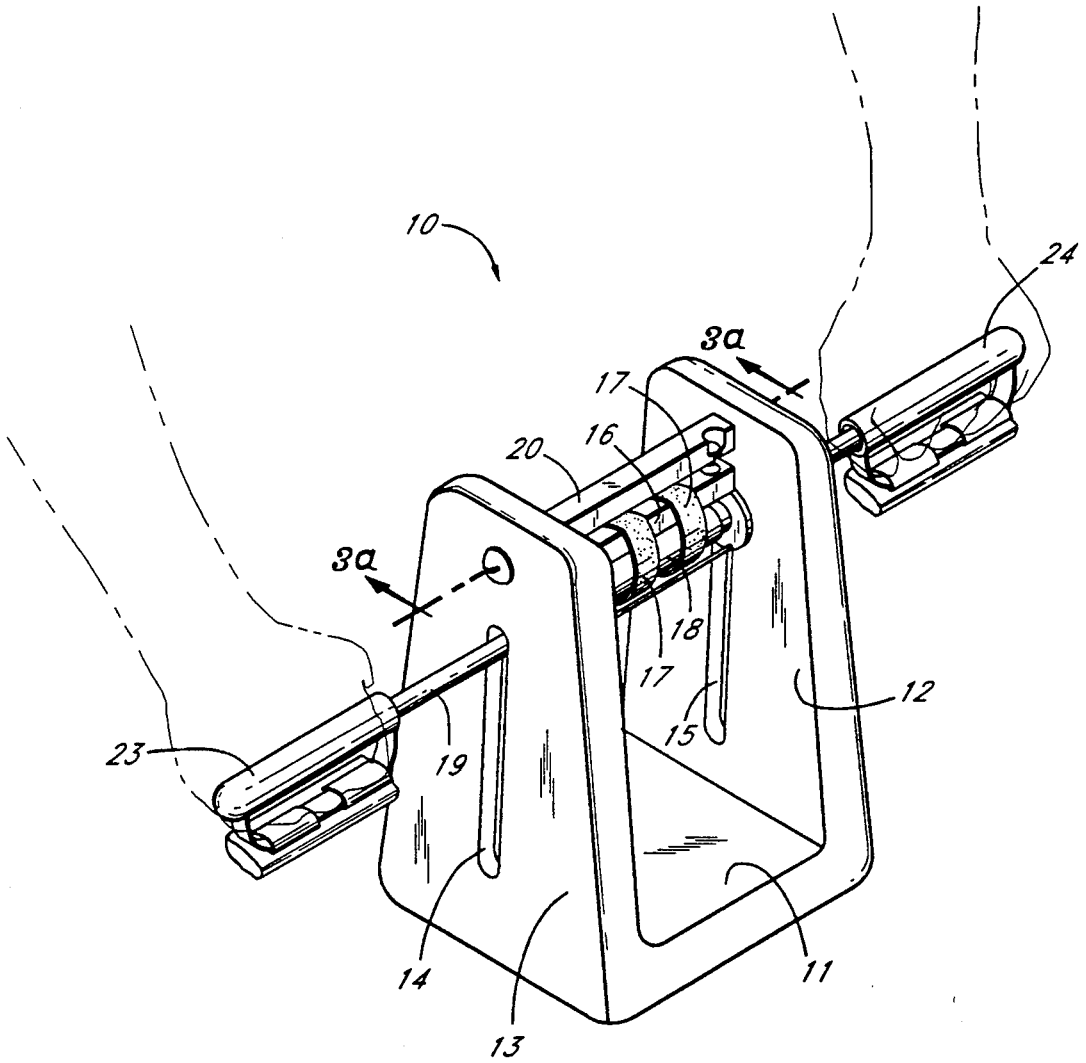
FIG. 1 is a perspective view of the exercising device of the present invention.

The compact and easily adjusted exercising device of the present invention is shown in perspective view in FIG. 1 and indicated generally by reference character 10. Device 10 has a base 11 which may be supported on a desk, table, the floor or on a book supported on the user's lap or any other appropriate support surface. A pair of opposed uprights 12 and 13 extend upwardly from base 11 and have generally vertical slots 14 and 15. The vertical slots shown in FIG. 1 are directed toward the center of base 11. While the term "vertical" is used herein, it should be understood that the slots can be slightly slanted, or even curved, depending on the particular exercise for which the device is fabricated.

An upper elastic member support bar 16 supports a pair of elastic members or rubber bands 17. A lower elastic member support bar 18 is, in turn, supported by the elastic members 17 and, as shown best in FIG. 2, is a hollow member through which a handle supporting bar 19 is inserted.

Figure 2:
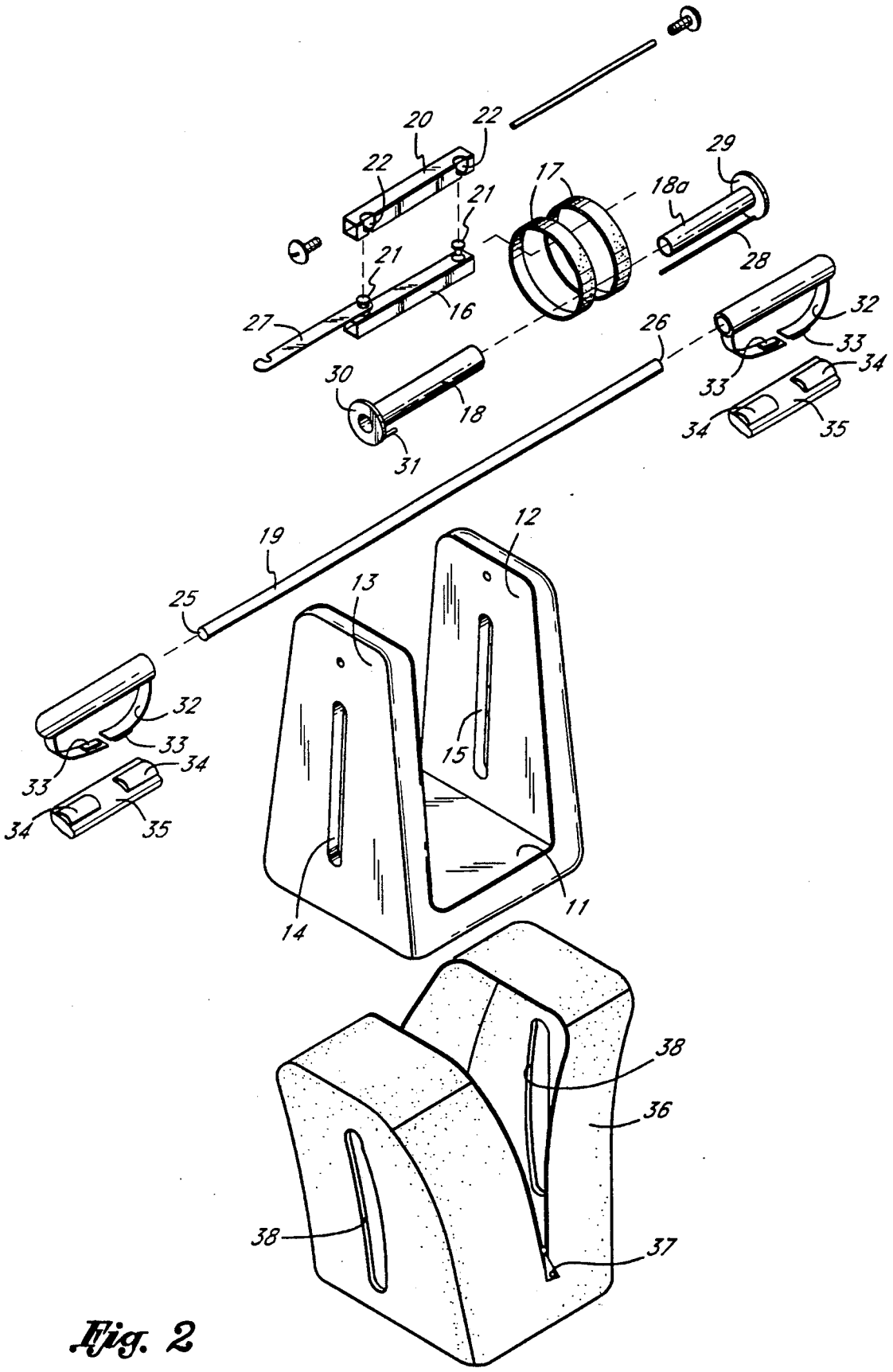
FIG. 2 is an exploded perspective view of the exercising device of FIG. 1 further including a protective cover.

The upper elastic member support bar is removably held on a cross brace 20 by a pair of pins 21 which fit into a pair of slots 22 in cross brace 20 (see FIG. 2). A pair of removable handles 23 and 24 are placed, respectively, over ends 25 and 26 (see FIG. 2) of handle supporting bar 19. To change the elastic members, one removes either handle 23 or 24 and withdraws handle supporting bar 19 from lower elastic member support bar 18. Next, the upper elastic member support bar is removed. Then, the elastic bands may be easily replaced, although as shown in FIG. 2, an additional safety bar 27 is supported by pins 21 and must be swung away from the upper elastic member support bar 16 to remove the elastic bands therefrom. Furthermore, the lower elastic member support bar 18 actually is fabricated with two parts wherein part 18*a* is inserted within the hollow center of part 18, and a safety bar 28 is held by flange 29 and passes into a hollow pin 31 held by flange 30. This further prevents a rubber band, when breaking from the upper support bar, from flying away from the device.

As also shown in FIG. 2, the handles have a pair of straps 32 which pass through loops 34 in pads 35 and are secured together by VELCRO type hook and eye material to further protect the knuckles in case of elastic band breakage. A safety cover 36 may be closed by a zipper type fastener 37 and is placed over the entire unit with the handle supporting bar 19 extending through the slots 38 therein.

Figure 3B:
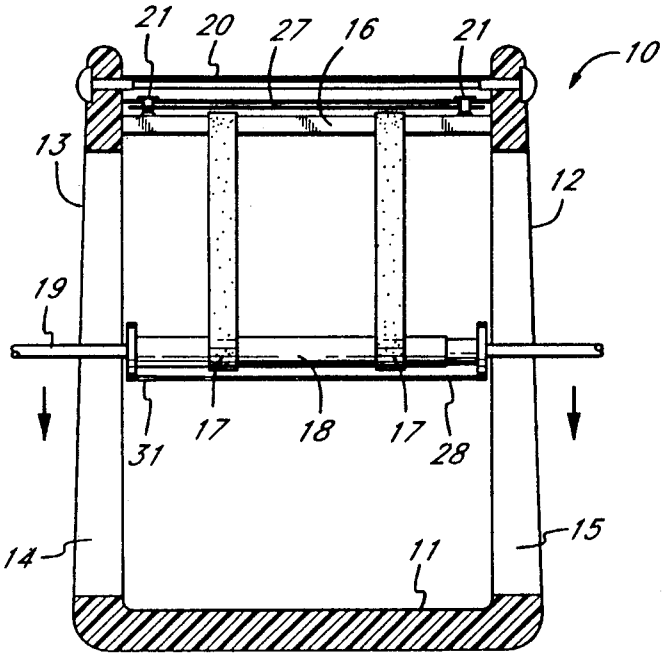
FIG. 3*b* is a cross-sectional view analogous to FIG. 3*a* except showing the handle supporting bar moved half way downwardly toward the base.
Figure 3A:
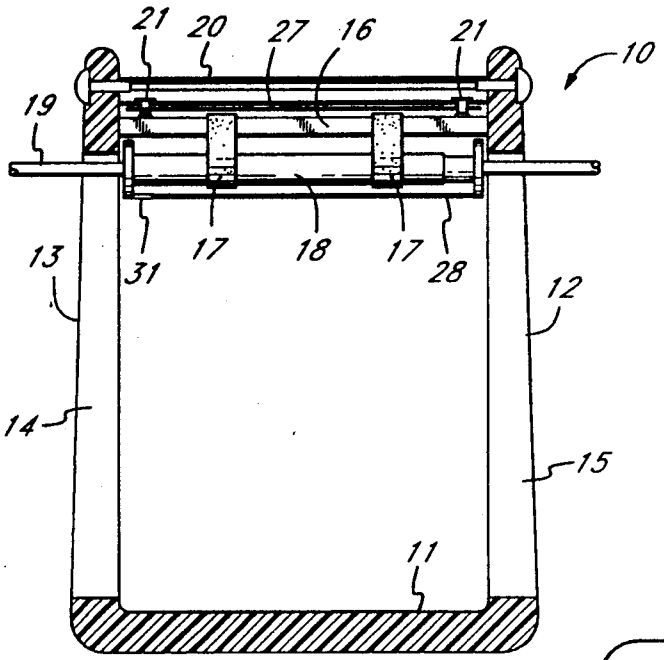
FIG. 3*a* is a cross-sectional view taken along line 3*a*–3*a* of FIG. 1.

The operation of the device is shown by viewing FIGS. 1 and 3a–3b. As the handle supporting bar 19 moves downwardly, the elastic bands 17 stretch resisting the force applied on the handle supporting bar.

Figure 4:
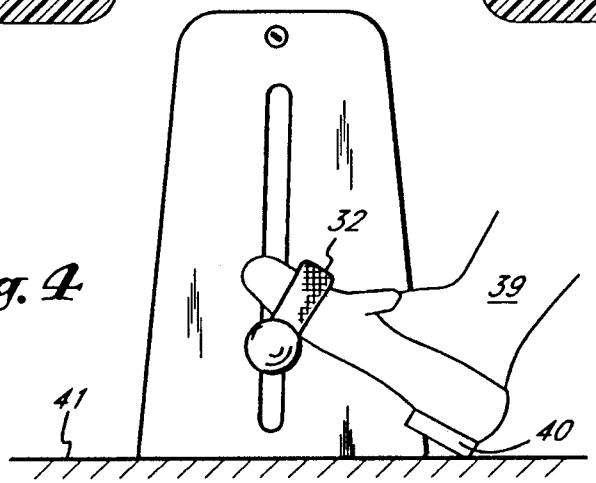
FIG. 4 is a side view showing the exercise device of FIG. 1 equipped for exercising the user's calves.

As shown in FIG. 4, the device has been placed on the floor and is used by placing the user's foot 39 into loop 32, and the user's heel 40 rests on the floor 41.

It is evident that the amount of force required to move the handle supporting bar downwardly may be easily adjusted adding more or less elastic bands or by adding elastic bands with greater or lesser elasticity. Thus the device may be used by all members of the family, and additional features such as a counter or a force exerting gauge may be added to further sustain interest in using the device. The device is sufficiently portable so that it may be used by persons during work or study to help relieve stress.

While the device is shown as having a cross brace and an upper elastic member support bar, it could, of course, simply have an upper elastic band support bar which is directly supported in a removable manner by the uprights such as in a slot.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

What is claimed is:

1. A compact and easily adjusted exercising device useful for exercising the upper arms, shoulders, calves and the like, said device comprising:

a base supportable on a desk, table or the floor;

a pair of opposed uprights supported by and extending upwardly from said base, each of said pair of opposed uprights having a generally vertical slot formed therein, said slots being aligned towards said base;

an upper, elastic member support bar supported, in turn, by said pair of opposed uprights, said upper, elastic member support bar being removable from at least one of said opposed uprights;

at least one elastic member supported by said upper, elastic member support bar and depending downwardly therefrom;

a lower, elastic member support bar supported by said at least one elastic member, said lower, elastic member support bar having first and second ends which fit lengthwise between said pair of opposed uprights, said lower elastic member support bar being supported only by said at least one elastic member and said lower elastic member support bar having an elongated opening therein, said elongated opening being alignable with said generally vertical slots in said pair of opposed uprights; and a handle supporting bar held by the elongated opening in said lower elastic member support bar and said handle supporting bar having first and second ends which extend past the first and second ends of said lower elastic member support bar through said generally vertical slots an extent sufficient so that handles may be inserted on the first and second ends of said handle supporting bar whereby when said handle supporting bar is grasped externally from said pair of opposed uprights, it may be moved downwardly and released repeatedly to provide exercise, and the amount of force required to move the handle supporting bar downwardly may be increased by increasing the number or decreasing the amount of elasticity of said at least one elastic member which may be changed by removing one of the handles from the handle supporting bar and then withdrawing the handle supporting bar from said lower elastic member support bar and removing the upper elastic member support bar and replacing, removing or increasing the number of elastic members and reassembling.

2. The exercising device of claim 1 wherein said device is covered by a removable cover including slots which match the generally vertical slots.

3. The exercising device of claim 1 wherein said lower elastic member support bar has an outwardly extending flange at each end.

4. The exercising device of claim 1 wherein said handle supporting bar includes first and second handles, at least one of said handles being easily removed to facilitate the removal of said handle supporting bar from said lower elastic member supporting bar.

5. The exercising device of claim 1 wherein said elastic member is a rubber band.

6. The exercising device of claim 5 wherein said elastic member is a plurality of rubber bands.

7. The exercising device of claim 1 wherein said generally vertical slots have a bottom end, which bottom end is sufficiently above said base so that if said at least one elastic member breaks, the handle supporting bar will not strike the surface upon which the base is supported.

8. A compact and easily adjusted exercising device useful for exercising the upper arms, shoulders, calves and the like, said device comprising:

a base supportable on a desk, table or the floor;

a pair of opposed uprights supported by and extending upwardly from said base, each of said pair of opposed uprights having a generally vertical slot formed therein, said slots being aligned towards said base;

a crossbar supported by said pair of opposed uprights above said generally vertical slots;

an upper rubber band support bar supported, in turn, by said crossbar, said upper rubber band support bar being removable from said crossbar;

at least one rubber band supported by said upper, rubber band support bar and depending downwardly therefrom;

a lower rubber band support bar supported by said at least one rubber band, said lower rubber band support bar having first and second ends which fit lengthwise between said pair of opposed uprights, said lower rubber band support bar being supported only by said at least one rubber band and said lower rubber band support bar having an elongated opening therein, said elongated opening being alignable with said generally vertical slots in said pair of opposed uprights; and a handle supporting bar held by the elongated opening in said lower rubber band support bar and said handle supporting bar having first and second ends which extend past the first and second ends of said lower elastic member support bar through said generally vertical slots an extent sufficient so that handles may be inserted on the first and second ends of said handle supporting bar whereby when said handle supporting bar is grasped externally from said pair of opposed uprights, it may be moved downwardly and released repeatedly to provide exercise, and the amount of force required to move the handle supporting bar downwardly may be increased by increasing the number or decreasing the amount of elasticity of said at least one rubber band which may be changed by removing one of the handles from the handle supporting bar and then withdrawing the handle supporting bar from said lower rubber band support bar and removing the upper elastic member support bar and replacing, removing or increasing the number of rubber bands and reassembling.

9. The exercising device of claim 8 wherein said upper and lower rubber band support bars include a safety bar which extends over the positions of the rubber bands which pass over or under said support bars.

10. The exercising device of claim 8 wherein said handle support bar includes a pair of handles, each of said handles includes a knuckle protecting pad.

11. The exercising device of claim 8 further including a removable safety cover which extends over the upper rubber band support bar.

* * * * *